US007445121B2

(12) United States Patent
Mainin et al.

(10) Patent No.: US 7,445,121 B2
(45) Date of Patent: Nov. 4, 2008

(54) DYNAMIC SEPARATOR

(76) Inventors: Burkit Mainin, Kazakhstan, 470074, Karaganda, mikroraion Kungei, 574 (KZ); Gulnar Ermekova, Kazakhstan, 470061, Karaganda, Bukhar-Zhirau Str., 36, apt. 18 (KZ); Zhanat Mainina, Kazakhstan, 470058, Karaganda, Komissarov Str., 10, apt. 1 (KZ); Zhibek Mainina, Kazakhstan, 470061, Karaganda, Bukhar-Zhirau Str., 36, apt. 17 (KZ)

( * ) Notice: Subject to any disclaimer, the term of this patent is extended or adjusted under 35 U.S.C. 154(b) by 424 days.

(21) Appl. No.: 10/523,860

(22) PCT Filed: Aug. 4, 2003

(86) PCT No.: PCT/KZ03/00005

§ 371 (c)(1),
(2), (4) Date: Aug. 11, 2005

(87) PCT Pub. No.: WO2004/016357

PCT Pub. Date: Feb. 26, 2004

(65) Prior Publication Data

US 2006/0016733 A1 Jan. 26, 2006

(30) Foreign Application Priority Data

Aug. 19, 2002 (KZ) ..... 2002/1085

(51) Int. Cl.
*B07B 1/42* (2006.01)

(52) U.S. Cl. ..... 209/365.2; 209/331; 209/379

(58) Field of Classification Search ..... 209/13, 209/309, 325–327, 331, 332, 365.1, 365.2, 209/373, 379, 380, 405, 425, 427, 409, 448, 209/449

See application file for complete search history.

(56) References Cited

U.S. PATENT DOCUMENTS 506,751 A * 10/1893 Wall ..... 209/427
4,279,741 A 7/1981 Campbell (Continued)

FOREIGN PATENT DOCUMENTS

| | | | |
|---|---|---|---|
| DE | 3308810 | A1 | 9/1984 |
| RU | 2 127 635 | C1 | 3/1999 |
| SU | 1530257 | A1 | 12/1989 |
| WO | WO 02/13974 | A1 | 2/2002 |

OTHER PUBLICATIONS

Burt, Richard O., Gravity Concentration Technology, 1990, pp. 206-207, Elsevier.

*Primary Examiner*—Joseph C Rodriguez
(74) *Attorney, Agent, or Firm*—Fraser Clemens Martin & Miller LLC; Donald R. Fraser

(57) ABSTRACT

A dynamic separator for the processing of minerals such as coal is provided. The dynamic separator includes two movable trays that are pivotally connected to each other and actuated by a specially constructed crankshaft. The positive motion of the trays makes it possible to obtain a uniform water pulse distribution, thereby preconditioning the stimulation of mineral processing. In addition, energy consumption for mineral processing is substantially reduced, structural design of the device is simplified, and the reliability thereof is significantly increased. Good technical results of mineral processing and high reliability and operability is thereby achieved.

3 Claims, 1 Drawing Sheet

U.S. PATENT DOCUMENTS 4,552,654 A 11/1985 Mansker
1,332,052 A 9/1994 Kelsey
6,070,738 A 6/2000 Lyman et al.
2,416,724 A1 1/2003 Mainin
6,889,845 B2 * 5/2005 Ermekova et al. ..... 209/365.1
6,910,588 B2 * 6/2005 Ermekova et al. ..... 209/405

* cited by examiner

DYNAMIC SEPARATOR

CROSS-REFERENCE DATA

The present patent application in an entry in national phase of the international patent application no. PCT/KZ2003/000005 filed Aug. 4, 2003, which claims priority of Kazakh patent application no. 2002/1085.1 filed Aug. 19, 2002.

FIELD OF THE INVENTION

This paper is dealing with processing minerals and can be used both in ore and mining industries, as well as in some others.

BACKGROUND OF THE INVENTION

There are certain jigging units with movable sieve (Directory on ore processing. Main processes. Moskow, Nedra, 1983, p.p. 53-54). The sieve is given bow-shaped movement with horizontal displacement towards the place of loading material with the sieve moving down and protruding it forward under moving up. As a result the positive effect is achieved due to simultaneous up going of the whole bed and pushing separating material forward along the sieve, the regulation of the sieve movement is done by replacement of the plates with cranks on the movable disks.

Disadvantage of the device is insufficient disintegration of the movable bed in the loading part of the sieve and mixing up of disintegrating fractions in the loading part. Thus, the efficiency of material disintegration is low. Due to these reasons as well as some others the type of the devices with the movable sieve did not find wide application.

There are jiggers with unmovable sieve, such as "THE WEMCO REMER JIG" (Annotation of the device—"THE WEMKO REMER JIG" WEMCO EGUIPMENT, COAL PLANTS 315C Street, St. Albans, W.Va.).

The device has an upper unmovable trough with a sieve and a lower movable one, both are connected by rubber diaphragm along perimeter. The lower trough gets vertical reciprocating movement by special doubled eccentric mechanism. As a result vertical pulsation of under-sieve water is being achieved that is very important for jigging.

Disadvantages of the machine are complexity of the design due to eccentric unit construction, high inertia of the lower part of the machine that results in high energy-consumption because of the fact that each cycle of jigging needs upraising of the lower trough with the whole amount of water, low efficiency of jigging as there is no simultaneous upraising of the whole bed that is characteristic of all jiggers with unmovable sieve.

As a prototype of a jigger, the machine with vibrating of the jigging sieve and water in counter-phase is used (Jigging machine. International Patent Classification B03B 05/16, international publication number: WO 02/13974, international publication date: 21 Feb. 2002 (21 Feb. 2002)). The machine consists of troughs connected hingedly by double-arm levers, the upper having a sieve inside and continuous flexible membrane at the bottom interacting with lower trough. The double-arm levers are hinged upon supports. Reciprocating movement of troughs is achieved by setting a drive in the center of axle of double-arm levers rotation, for example, turning gate hydraulic engine. Thereby reciprocating movement of troughs is taking place both in vertical surface—for jigging performance and in the horizontal one—for transporting processing mineral to the place of unloading out of the jigger. The double-arm levers together with troughs form a system of hinge parallelogram, that results in uniform pulsation of under-sieve water and simultaneous uprising of the whole bed, that's very important for efficiency of jigging.

Because of the cinematic scheme and correspondingly the design itself the disadvantages of the machine are that the troughs make reciprocal motion and as result of this the considerable part of the drive capacity is spent to overcome inertia rather than to the useful performance. Besides it result in considerable additional loads over the drive and hinges of the machine that is negatively effects reliability of the machine.

SUMMARY OF THE INVENTION

Technical task of the invention is to design a simple and reliable in construction unit with low power-consuming jigging process.

The separator we offer by our invention consists of two movable troughs, hinged via crankshafts. The upper trough has a sieve. The unit has flexible membrane made in the form of an endless stripe, one edge of that is achieved to the upper tough, and the other—to the lower one. Movement of toughs is achieved by torque transmission from a drive (e.g. Electric engine) to the crankshaft, and from it to the troughs. The troughs make advance movement along curved closed trajectory—circumference. Extreme and inner cranks of the crankshaft are located in respect to each other with the displacement of 180 degree, that provides the movement of troughs in counter-phase. In this case the design of the unit is simplified considerably due to absence of the usage of double-arm levers, reliability is increased thanks to removal inertia forces and energy consumption of jigging is decreased as both troughs move along closed trajectory and their masses perform only positive work. Negative effect upon the base is minimized due to full balance of moving masses of the unit.

To improve reliability durability and simplicity of the flexible membrane the latter has been done not as a continuous but as an endless stripe both edges of which are attached to the troughs.

Thus, constructive differences of this unit give possibilities to solve the technical task—decreasing power intensity, reduction design and increasing reliability of the unit. Consequently, these differences are very essential. To our mind, they give possibility to provide the proper technical level to the given invention. Industrial usage of it is out of any doubt.

DETAILED DESCRIPTION OF THE EMBODIMENTS

Figure 1:
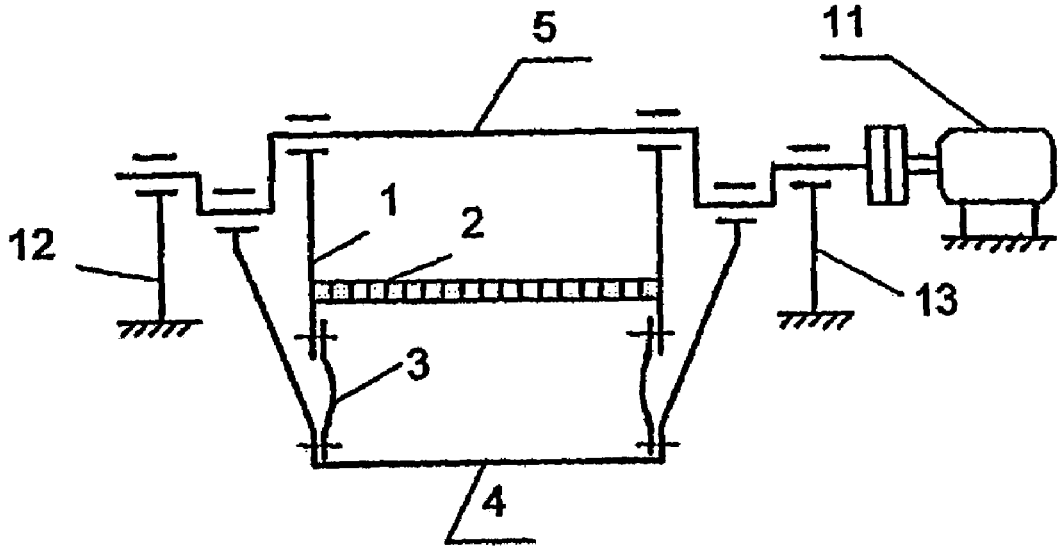
FIG. 1—kinematic scheme of the unit.
Figure 2:
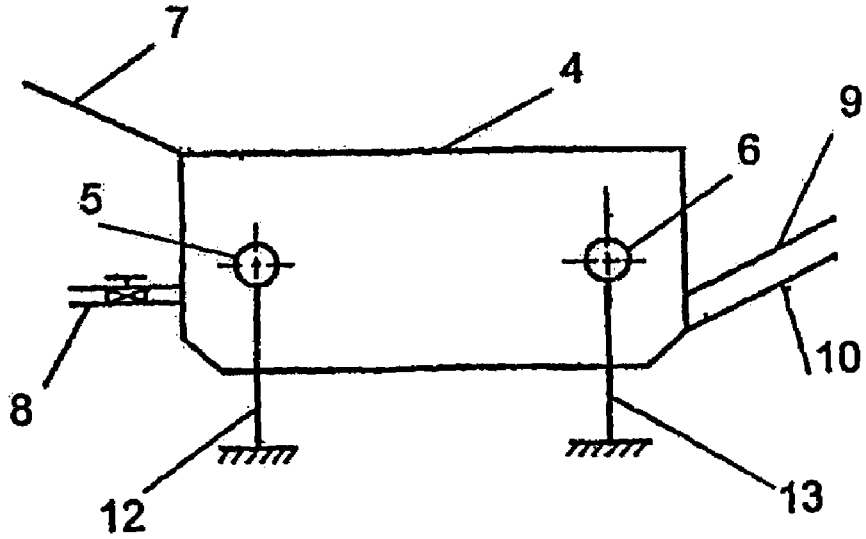
FIG. 2—the design of the unit, side sight.

The unit consists of upper trough 1 with sieve 2 and flexible membrane 3 attached at the bottom, lower trough 4 with attached to it flexible membrane 3 and hinged to upper trough 1 with the help of crankshafts 5 and 6. At the back butt end of upper trough 1 there is a loading unit 7, water along flexible hose 8 is given to under sieve 2. Unloading processing products is done through unloading units 9 and 10 placed on front butt end of trough 1. The troughs are put into operation via the crankshaft by drive 11. Crankshafts 5 and 6 are hinged on supports 12 and 13.

The given device operates in the following way. Material processed is given onto upper trough 1 out of loading unit 7. Drive 11 via crankshaft gives advance movement to troughs 1 and 4. Synchronously with the movement of lower trough 4 downward replacement of upper 1 with sieve 2 takes place upwards that provides uprising of the whole bed. With the movement of upper trough 1 together with sieve 2 downward lower trough 4 synchronously moves upwards and produces vertical pulsation of under-sieve water. Products processing are removed through unloading units 9 and 10. Loss of water during unloading is compensated by permanent supplying of water though hose 8.

INDUSTRIAL USAGE

Additional technical result of using the given invention is its multi functionality—possibility to use it as transporting device or screen. Kinematic scheme of the given device permits to increase its individual capacity many times due to simple increasing its linear dimensions and changing the frequency of troughs pulsation without complication of the unit's design.

Basing on the experience of using such devices for a certain concrete kind of a mineral of a certain size there is optimal amplitude of vibrating. That's why to operate the process of effective dressing under given optimal amplitude it's enough to regulate the frequency of vibration, made by the usage of regulated electro- or hydraulic circuit.

Tests of the pilot sample of the device proved low energy intensity of processing and high reliability of the device simple both in manufacturing and using.

The invention claimed is:

1. A dynamic separator comprising:

a movable upper trough having a sieve;

a movable lower trough hinged with the upper trough;

a drive for moving said upper trough and said lower trough; and units for loading minerals into said upper trough, for supplying water beneath said sieve and for discharging processed products away from said separator;

characterized in that there is further included crankshafts, hingedly engaging said upper trough and said lower trough and synchronously downwardly moving said upper trough together with said sieve while said lower trough moves upwardly, wherein a rotary movement of said upper and lower troughs is achieved so that vertical pulsation of water beneath said sieve is achieved; and a flexible membranes, made in the form of an endless strip, said strip having opposite one edge and another edge, said one edge attached to said upper trough and said another edge attached to said lower trough.

2. A dynamic separator, comprising:

an upper trough having a sieve, closed from below by a continuous flexible membrane, and defining two sides, said upper trough for containing water and minerals to be processed;

a lower trough defining two sides;

one and another crankshafts, each defining first and second ends, each crankshaft hinged at its said first end to a corresponding side of said upper trough, and each crankshaft hinged at its said second end to a corresponding side of said lower tough;

at least two supports, each of said crankshafts hingedly carried on a corresponding one of said supports;

a driving gear, for pivotally actuating each of said crankshafts relative to said supports;

a device for loading minerals into said upper trough;

a device for water delivery beneath said sieve; and a device for unloading processed products away from said separator, wherein said crankshafts synchronously downwardly move said upper trough together with said sieve while said lower trough moves upwardly in a rotary movement of said upper troughs and said lower troughs, so that vertical pulsation of water beneath said sieve is achieved.

3. The dynamic separator according to claim 2, wherein said flexible membrane is made from an endless strip, said strip defining opposite one edge portion and another edge portion, said one edge portion being attached to said upper trough sides and said another edge portion attached to said lower trough sides.

* * * * *